US007487753B2

(12) United States Patent
Gotou et al.

(10) Patent No.: US 7,487,753 B2
(45) Date of Patent: Feb. 10, 2009

(54) GLOW PLUG ENERGIZATION CONTROL APPARATUS AND METHOD

(75) Inventors: Shunsuke Gotou, Nagoya (JP); Hiroshi Ono, Nagoya (JP); Masanori Ootubo, Nagoya (JP)

(73) Assignee: NGK Spark Plug Co., Ltd., Aichi (JP)

( * ) Notice: Subject to any disclaimer, the term of this patent is extended or adjusted under 35 U.S.C. 154(b) by 130 days.

(21) Appl. No.: 11/730,171

(22) Filed: Mar. 29, 2007

(65) Prior Publication Data

US 2007/0227488 A1 Oct. 4, 2007

(30) Foreign Application Priority Data

Mar. 29, 2006 (JP) ..... 2006-092202

(51) Int. Cl.
*F02P 19/00* (2006.01)

(52) U.S. Cl. ..... 123/145 A; 123/436

(58) Field of Classification Search ..... 123/145 A, 123/436, 142.5 E

See application file for complete search history.

(56) References Cited

U.S. PATENT DOCUMENTS 4,947,808 A * 8/1990 Kawamura ..... 123/145 A
5,922,229 A * 7/1999 Kurano ..... 219/270
6,843,218 B2 1/2005 Kumada et al.
2002/0033155 A1* 3/2002 Jung ..... 123/145 A
2002/0175156 A1* 11/2002 Hotta et al. ..... 219/270
2003/0010306 A1* 1/2003 Nishimoto ..... 123/145 A
2005/0081812 A1* 4/2005 Toedter et al. ..... 123/145 A
2008/0210186 A1* 9/2008 Stoller ..... 123/145 A

FOREIGN PATENT DOCUMENTS

JP 56-129763 10/1981
JP 60-67775 4/1985
JP 2004-44580 2/2004
JP 2004-232907 8/2004
JP 2005-240707 9/2005

* cited by examiner

*Primary Examiner*—Erick Solis
(74) *Attorney, Agent, or Firm*—Sughrue Mion, PLLC

(57) ABSTRACT

There is provided an energization control apparatus for a glow plug in an engine, including a post-start glow section to control energization of a resistance heater of the glow plug by a battery after start of the engine. The post-start glow section is configured to evaluate revolution stability of the engine and control the energization of the resistance heater according to a first control pattern when the engine revolution stability is higher than or equal to a threshold level and according to a second control pattern that achieves a higher temperature of the sheath heater than the first control pattern when the engine revolution stability is lower than the threshold level.

9 Claims, 12 Drawing Sheets

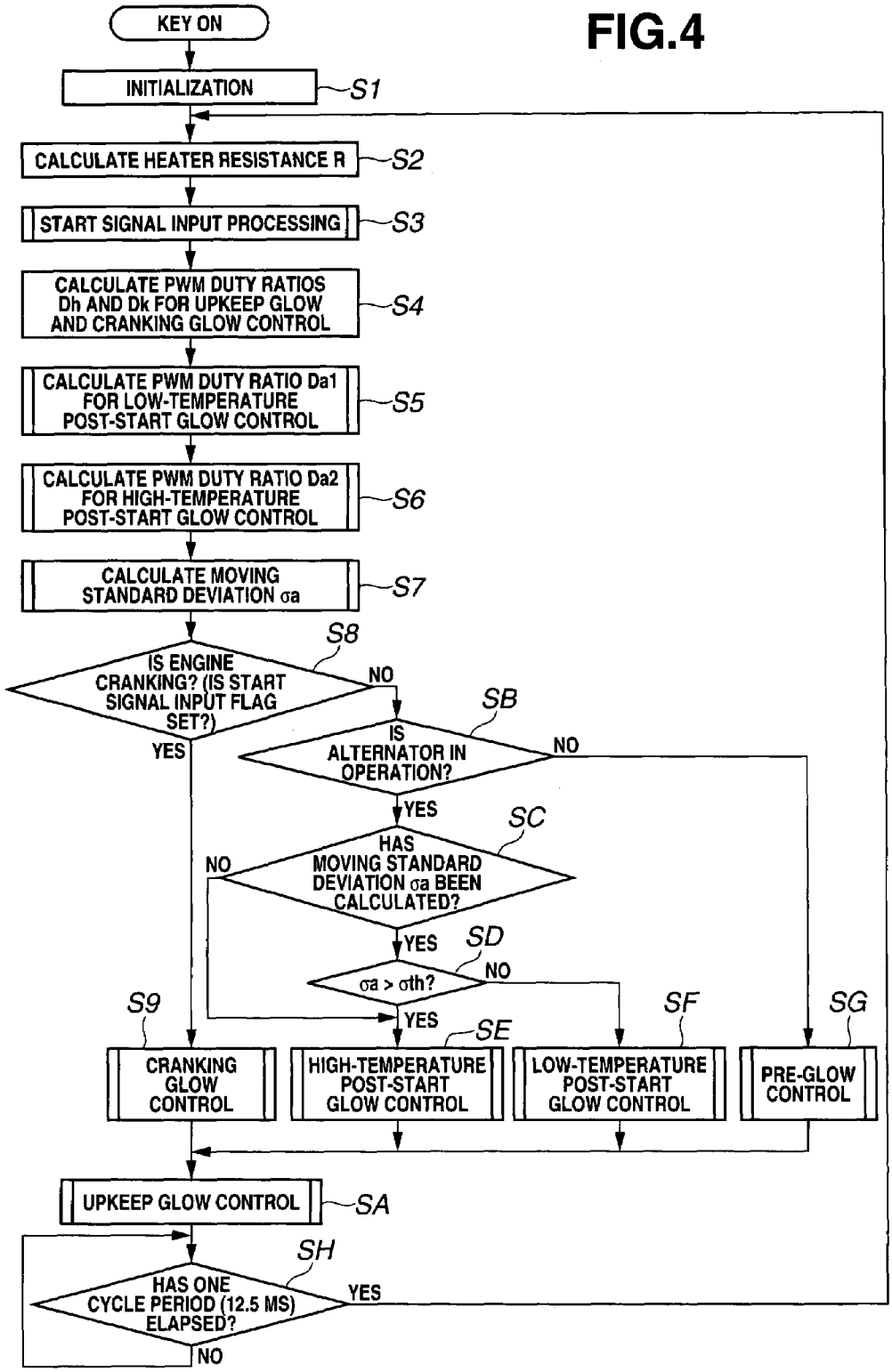
FIG.4
KEY ON
INITIALIZATION
S1
CALCULATE HEATER RESISTANCE R
S2
START SIGNAL INPUT PROCESSING
S3
CALCULATE PWM DUTY RATIOS Dh AND Dk FOR UPKEEP GLOW AND CRANKING GLOW CONTROL
S4
CALCULATE PWM DUTY RATIO Da1 FOR LOW-TEMPERATURE POST-START GLOW CONTROL
S5
CALCULATE PWM DUTY RATIO Da2 FOR HIGH-TEMPERATURE POST-START GLOW CONTROL
S6
CALCULATE MOVING STANDARD DEVIATION σa
S7
S8
IS ENGINE CRANKING? (IS START SIGNAL INPUT FLAG SET?)
NO
YES
SB
IS ALTERNATOR IN OPERATION?
NO
YES
SC
HAS MOVING STANDARD DEVIATION σa BEEN CALCULATED?
NO
YES
SD
σa > σth?
NO
YES
S9
SE
SF
SG
CRANKING GLOW CONTROL
HIGH-TEMPERATURE POST-START GLOW CONTROL
LOW-TEMPERATURE POST-START GLOW CONTROL
PRE-GLOW CONTROL
UPKEEP GLOW CONTROL
SA
SH
HAS ONE CYCLE PERIOD (12.5 MS) ELAPSED?
YES
NO

GLOW PLUG ENERGIZATION CONTROL APPARATUS AND METHOD

BACKGROUND OF THE INVENTION

The present invention relates to an apparatus and method for controlling the energization of a glow plug disposed in an internal combustion engine.

Hereinafter, the term "front" refers to a heating end side with respect to the axial direction of a glow plug, and the term "rear" refers to a side opposite the front side.

Glow plugs are generally equipped with resistance heaters and mounted on diesel engines to aid engine starting. Various energization control techniques have been proposed for the glow plugs.

Japanese Laid-Open Patent Publication No. 56-129763 and No. 60-67775 propose one type of glow plug energization control technique in which the energization control includes two control phases: "pre-glow" and "after-glow". The pre-glow phase is performed upon actuation of a key switch to supply a large amount of power to the glow plug and raise the temperature of the resistance heater to a first target temperature rapidly during several seconds. The first target temperature is set at e.g. 1000° C. sufficiently high to assist engine starting at any time before the engine start. After the resistance heater reaches the first target temperature, the after-glow phase is performed to supply a smaller amount of power to the glow plug and maintain the temperature of the resistance heater at a second target temperature for a predetermined time period. The second target temperature is set at e.g. 900° C. so as to promote engine warm-up, prevent engine knocking and limit noise and white smoke developments and reduce HC emissions after the engine start.

In this energization control technique, however, the resistance heater temperature may once drop and become lower than the second target temperature immediately after shifting from the pre-glow phase to the after-glow phase or when the engine starts cranking during the after-glow phase.

In order to avoid such a drop in resistance heater temperature, Japanese Laid-Open Patent Publication No. 2004-232907 proposes another glow plug energization control technique in which the energization control includes four control phases: "pre-glow", "upkeep glow", "cranking glow" and "post-start glow (or after-starting glow)" in such a manner as to supply a larger amount of power to the glow plug during the cranking glow phase than during the preceding upkeep glow phase.

SUMMARY OF THE INVENTION

In the case where the engine starts by cranking under low-temperature conditions, there is a possibility that rough idling may occur for a long time to cause large engine vibration and unstable engine revolution due to the occurrence of misfire in a cylinder or cylinders of the engine. This results in driver's discomfort and unburned gas emissions.

It is conceivable to maintain the resistance heater temperature at a higher level in order to assist ignition, avoid misfire and prevent engine rough idling. The resistance heater however deteriorates in durability when the resistance heater temperature is maintained at such a higher level.

It is therefore an object of the present invention to provide an apparatus and method for controlling the energization of a glow plug disposed in an internal combustion engine so as to shorten unstable engine revolution time after the engine start while securing durability for the glow plug (resistance heater).

According to one aspect of the present invention, there is provided an energization control apparatus for a glow plug in an engine, comprising: a post-start glow section to control energization of a resistance heater of the glow plug by a battery after start of the engine, wherein the post-start glow section being configured to: evaluate revolution stability of the engine; and control the energization of the resistance heater according to a first control pattern when the engine revolution stability is higher than or equal to a threshold level and according to a second control pattern that achieves a higher temperature of the sheath heater than the first control pattern when the engine revolution stability is lower than the threshold level.

According to another aspect of the present invention, there is provided an energization control apparatus for a glow plug in an engine, comprising: judging means for judging start of the engine; evaluating means for evaluating revolution stability of the engine; low-temperature post-start glow means for controlling energization of a resistance heater of the glow plug so as to attain a first target post-start glow temperature when the engine revolution stability is higher than or equal to a threshold level after the start of the engine; and high-temperature post-start glow means for controlling the energization of the resistance heater of the glow plug so as to attain a second target post-start glow temperature higher than the first target post-start glow temperature when the engine revolution stability is lower than the threshold level after the start of the engine.

According to still another aspect of the present invention, there is provided an energization control method for a glow plug in an engine, comprising: judging start of the engine; evaluating revolution stability of the engine; controlling energization of a resistance heater of the glow plug so as to attain a first target post-start glow temperature when the engine revolution stability is higher than or equal to a threshold level after the start of the engine; and controlling the energization of the resistance heater of the glow plug so as to attain a second target post-start glow temperature higher than the first target post-start glow temperature when the engine revolution stability is lower than the threshold level after the start of the engine.

The other objects and features of the present invention will also become understood from the following description.

BRIEF DESCRIPTION OF THE DRAWINGS

FIG. 4 is a flowchart for a main energization control routine of the glow plug energization control apparatus according to one embodiment of the present invention.

DESCRIPTION OF THE EMBODIMENTS

The present invention will be described in detail below with reference to the drawings.

The following exemplary embodiment of the present invention refers to a glow plug energization control system 100 for controlling the energization of n number of glow plugs GP (GP1 to GPn) in an internal combustion diesel engine.

The structures of the glow plugs GP (GP1 to GPn) will be first explained blow.

Figure 2:
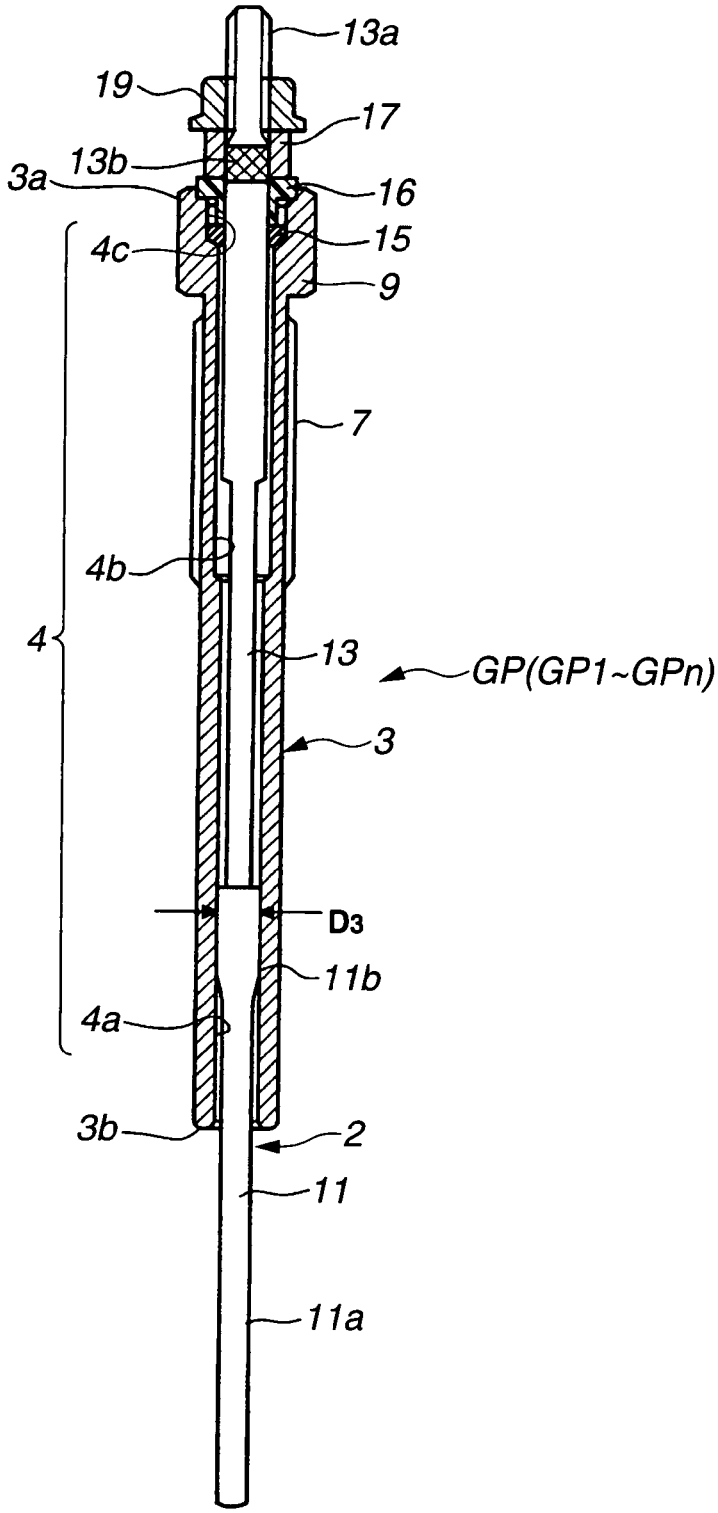
FIG. 2 is a section view of a glow plug controllable by the glow plug energization control system according to one embodiment of the present invention.
Figure 3:
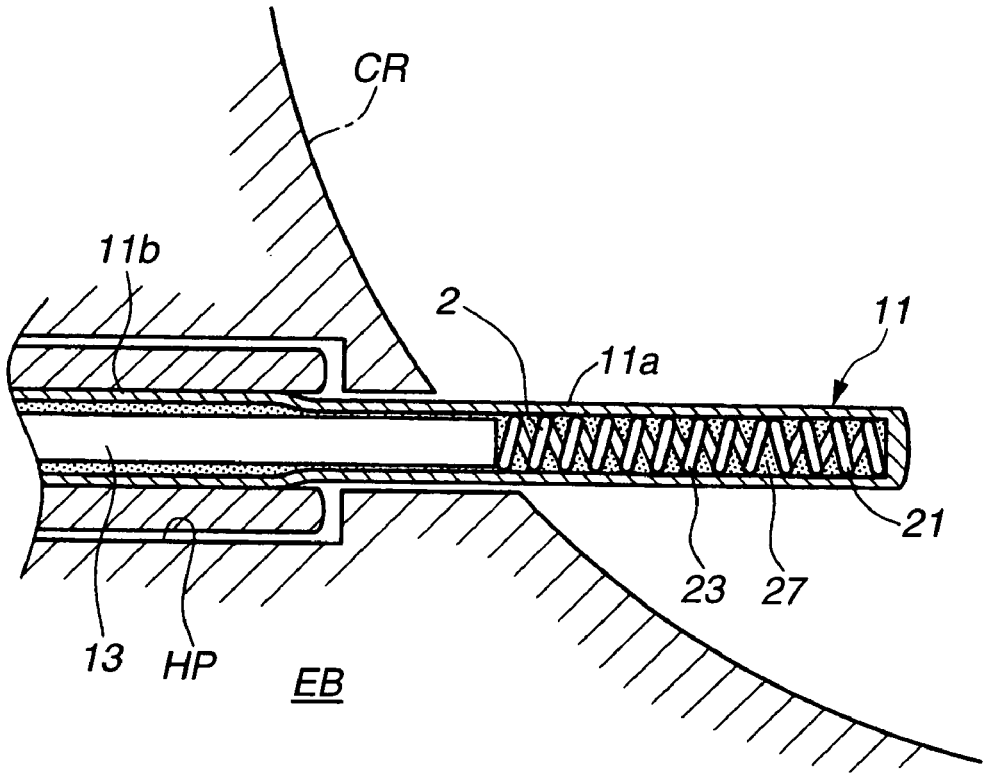
FIG. 3 is a schematic view showing how the glow plug is mounted on an engine cylinder block.

As shown in FIGS. 2 and 3, each of the glow plugs GP is provided with a sheath heater 2 as a resistance heater, a cylindrical metal shell 3, a terminal rod 13, an O ring 15, an insulating bushing ring 16, a push ring 17 and a nut 19.

The sheath heater 2 includes a sheath tube 11 formed with a closed front end, a plurality of resistance coils: a heating coil 21 and a control coil 23 connected in series and an insulating material 27. The sheath tube 11 has a front cylindrical portion 11*a* and a rear cylindrical portion 11*b* larger in diameter than the front cylindrical portion 11*a*. The heating coil 21 and the control coil 23 are arranged in the front cylindrical portion 11*a* of the sheath tube 11. As shown in FIG. 3, a rear end of the heating coil 21 is connected to a front end of the control coil 23 whereas a front end of the heating coil 21 is connected to the sheath tube 11. The heating coil 21 can be made of a material, such as Fe—Cr alloy or Ni—Cr alloy, having an electrical resistivity R20 of 80 to 200 μΩ·cm at 20° C. and an electrical resistivity R1000 at 1000° C. to satisfy a resistivity ratio R1000/R20 of 0.8 to 3. The control coil 23 can be made of a material, such as Ni, Co—Fe alloy or Co—Ni—Fe alloy, having an electrical resistivity R20 of 5 to 20 μΩ·cm at 20° C. and an electrical resistivity R1000 at 1000° C. to satisfy a resistivity ratio R1000/R20 of 6 to 20. The insulating material 27 is of e.g. magnesia powder and filled in the sheath tube 11 so as to keep peripheral surfaces of the coils 21 and 23 insulated from an inner surface of the sheath tube 11. The sheath heater 2 is retained in an axial through hole 4 of the metal shell 3 with a front side of the cylindrical portion 11*a* of the sheath tube 11 protruding from a front end 3*b* of the metal shell 3 by a predetermined length as shown in FIG. 2.

The terminal rod 13 is inserted through the rear cylindrical portion 11*b* of the sheath tube 11 and connected at a front end thereof to a rear end of the control coil 23 by e.g. welding.

The metal shell 3 has a hexagonal portion 9 formed at around a rear end 3*a* for engagement with a glow plug mounting tool such as a torque wrench and a threaded portion 7 formed at a front side of the tool engagement portion 9. The through hole 4 of the metal shell 3 consists of a front section 4*a* extending to the front end 3*b* of the metal shell 3, a rear section 4*c* formed by spot facing in the rear end 3*a* of the metal shell 3 and a middle section 4*b* extending between the front and rear sections 4*a* and 4*c*. The rear cylindrical portion 11*b* of the sheath tube 11 is press-fitted in the front section 4*a* of the through hole 4 of the metal shell 3.

The O ring 15 is of rubber and is fitted around the terminal rod 13 and pushed in the rear section 4*c* of the through hole 4 of the metal shell 3. The bushing ring 16 is of e.g. nylon and is also fitted around the terminal rod 13 and pushed in the rear section 4*c* of the through hole 4 of the metal shell 3. Further, the push ring 17 is fitted on the terminal rod 13 to prevent the bushing ring 16 from becoming detached. In order to strengthen the coupling between the terminal rod 13 and the push ring 17, the push ring 17 is swaged onto a knurled surface portion 13*b* of the terminal rod 13.

The nut 19 is screwed onto a threaded rear end portion 13*a* of the terminal rod 13 for connection to the glow plug energization control system 100 via an electrical cable.

As shown in FIG. 3, the glow plug GP is mounted on a cylinder block EB of the engine by screwing the threaded portion 7 of the metal shell 3 into a plug hole HP of the engine cylinder block EB in such a manner that the front side of the cylindrical portion 11*a* of the sheath tube 11 protrudes in a combustion chamber CR of the engine by a predetermined length. In the present embodiment, the whole of the heating coil 21 and almost the whole of the control coil 23 are located within the engine combustion chamber CR.

Next, the configuration of the glow plug energization control system 100 will be explained blow.

Figure 1:
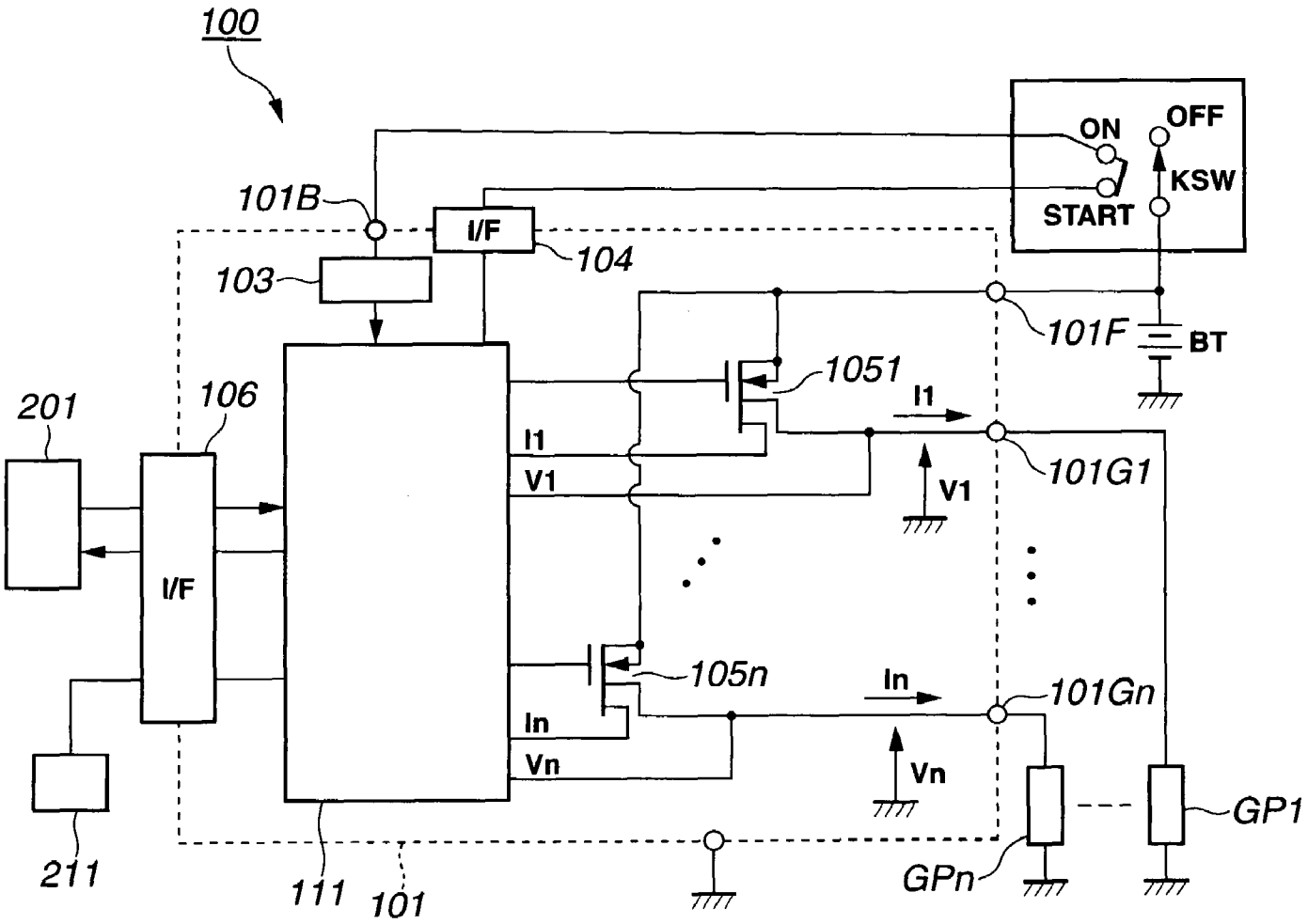
FIG. 1 is a block diagram of a glow plug energization control system equipped with a glow plug energization control apparatus according to one embodiment of the present invention.

As shown in FIG. 1, the glow plug energization control system 100 is provided with a glow plug energization control apparatus 101 (indicated by a broken line), a battery BT, a key switch KSW, an engine control unit (ECU) 201 and an alternator 211.

The glow plug energization control apparatus 101 has a post-start glow section or means for, after start of the engine, controlling the energization of the sheath heater 2 of each glow plug GP by the battery BT based on engine start information. The post-start glow section or means is configured to: evaluate revolution stability of the engine; and control the energization of the sheath heater 2 according to a first post-start glow control pattern so as to attain a first target post-start glow temperature of e.g. 900° C. when the engine revolution stability is higher than or equal to a given level and according to a second post-start glow control pattern so as to attain a second target post-start glow temperature of e.g. 1000° C. higher than the first target post-start glow temperature when the engine revolution stability is lower than the given level.

In the present embodiment, the glow plug energization control apparatus 101 is comprised of a main control unit 111, n number of switching elements 1051 to 105*n*, a power supply circuit 103, interface circuits 104 and 106 and terminals 11B, 101F and 101G1 to 101Gn as shown in FIG. 1.

The power supply circuit 103 receives power from the battery BT via the key switch KSW and the power terminal 101B and provides a stable supply of operation voltage to effect the operations (signal processing etc.) of the main control unit 111 when the key switch KSW is turned by a driver to the ON position or START position. When the key switch KSW is turned to the OFF position, the power supply from the battery BT to the power supply circuit 103 and the main control unit 111 is cut off to stop the operations of the main control unit 111.

The switching elements 1051 to 105*n* are equipped with power MOSFETs (metal oxide semiconductor field-effect transistors) available e.g. under the trade name of "PROFET" from Infineon Technologies AG. Each of the MOSFETs performs a current detection function to generate a current signal responsive to the intensity of its drain-source current and output the current signal to the main control unit 111. More specifically, these MOSFETs have drains to receive voltage power from the battery BT via the battery terminal 101F, sources to feed electric currents to the glow plugs GP (GP1 to GPn) via the glow terminals 101G1 to 101Gn and gates to receive switching signals from the main control unit 111 for drain-source current switching control, i.e., for on-off energization control of the glow plugs GP in response to the switching signals.

The interface circuit 104 allows communication between the main control unit 111 and the key switch KSW so that the main control unit 111 judges whether the key switch KSW is in the ON position, START position or OFF position e.g. upon receipt of a start signal (indicating that the key switch KSW is in the START position) etc. from the key switch KSW.

On the other hand, the interface circuit 106 allows communication between the main control unit 111 and the ECU 201, when the ECU 201 periodically obtains a detection signal responsive to a revolution number N of the engine from an engine speed sensor or a crank angle sensor (not shown), the main control unit 111 receives input on the engine revolution number N from the ECU 201. The interface circuit 106 also allows communication between the main control unit 111 and the alternator 211 so that the main control unit 111 receives a driving signal from of the alternator 211.

The main control unit 111 has a microprocessor equipped with a CPU, a ROM and a RAM and an A/C converter to perform the function of the post-start glow section or means although not shown in the drawing. Further, the main control unit 111 reads voltages V (V1 to Vn) applied from the battery BT to the glow plugs GP (GP1 to GPn), determines electric currents I (I1 to In) flowing to the glow plugs GP (GP1 to GPn) and monitors the amount of power supplied to each of the glow plugs GP. In the main control unit 11, the glow plug voltages V and the glow plug currents I are digitized by the A/C converter and processed by the microcomputer as discussed later. Upon receipt of the signal inputs from the ECU 201, the alternator 211, the key switch KSW and the switching elements 1051 to 105*n* etc., the main control unit 111 conducts energization control in accordance with a prestored program to control the energization of each of the sheath heaters 2 (glow plugs GP).

The energization control of the glow plug energization control apparatus 101 will be explained in detail below.

In the present embodiment, the energization control includes four control phases: "pre-glow", "upkeep glow", "cranking glow" and "post-start glow".

The pre-glow is performed when the key switch KSW is turned from the OFF position to the ON position. The energization of the sheath heater 2 during the pre-glow (referred to as "pre-glow energization") is done by applying the voltage of the battery BT directly and continuously to the glow plug GP so that the temperature TG of the sheath heater 2 rises to a target pre-glow temperature of e.g. 1000° C. rapidly in a short time.

The upkeep glow is performed when the heater temperature TG reaches the target pre-glow temperature. The energization of the sheath heater 2 during the upkeep glow (referred to as "upkeep glow energization") is controlled to prevent a drop in the heater temperature TG The cranking glow is performed when the key switch KSW is turned to the START position to initiate engine cranking during the upkeep glow. The energization of the sheath heater 2 during the cranking glow (referred to as "cranking glow energization") is controlled to supply a larger amount of power to the glow plug GP and prevent a drop in the heater temperature TG assuredly for improvement in engine startability.

The post-start glow is performed after the start of the engine. In present embodiment, the post-start glow is selected between low-temperature post-start glow and high-temperature post-start glow depending on the result of evaluation of the engine revolution stability in order to control the energization of the sheath heater 2 according to either the first post-start glow control pattern or second post-start glow control pattern as mentioned above. This post-start glow ensures higher engine revolution stability, prevents noise and white smoke developments and reduces HC emissions immediately after the engine start.

The timing of initiation of the post-start glow is determined based on engine start information. The engine start information can be any information by which it can be judged whether the engine has started or not. Examples of the engine start information are about whether the engine revolution number N exceeds a threshold level Nth (e.g. several hundred rpm), whether the alternator 211 is generating power, whether the power generation amount of the alternator 211 exceeds a threshold level, whether the key switch KSW is turned from the START position to the ON position and a combination thereof. The timing of initiation of the post-start glow can be set to e.g. a time after engine start and before completion of engine cranking, a time of completion of engine cranking (when the key switch is turned from the START position to the ON position or when there arises a command to stop engine cranking) after engine start or a time after engine start and after completion of engine cranking.

The evaluation of the engine revolution stability is made based on engine revolution information. There is no particular restriction on the method of evaluation of the engine revolution stability as long as the method allows real-time evaluation of the engine revolution stability. The engine revolution information can be any information relating to the engine revolution number N and obtained from any external device by data communication. For direct, proper and accurate evaluation of the engine revolution stability, it is preferable to use, as the engine revolution information, the engine revolution number N itself or the moving average value of the engine revolution number N. In the present embodiment, the control unit 111 preferably retrieves the engine revolution information from the ECU 201 for ease of data acquisition and processing because the ECU 201 receives input about the engine revolution number N via the sensor. Alternatively, the control unit 111 may receive input about the engine revolution number N directly via the sensor.

For example, the engine revolution stability can be evaluated by obtaining the engine revolution information periodically, calculating a difference ΔN between the current and last values of the engine revolution number N, and then, determining that the engine revolution is stable when the difference ΔN is kept smaller than or equal to a threshold value for a predetermined time period and that the engine revolution is not stable when the difference ΔN exceeds the threshold value. However, there is a possibility that the engine revolution stability may not be evaluated properly and accurately based on the difference ΔN in view of the fact that the difference ΔN varies significantly with time during the duration of engine rough idling.

It is accordingly preferable to evaluate the engine revolution stability by obtaining the engine revolution information periodically over several times and calculating a moving standard deviation σa of the engine revolution number N. A larger moving standard deviation σa means that the engine revolution number N varies greatly with time, i.e., the engine revolution stability is low. The engine revolution is determined to be stable when the moving standard deviation σa is smaller than or equal to a threshold value σth and to not be stable when the moving standard deviation σa exceeds the threshold value σth. When the moving standard deviation σa is calculated based on multiple values of the engine revolution number N, there arises no sudden change of the standard deviation σa in response to a temporary change in the engine revolution number N. Further, the moving standard deviation σa gradually decreases as the engine revolution becomes stable with less occurrence of misfire. The moving standard deviation σa is thus suitable as one measure to make proper and accurate evaluation of the engine revolution stability.

For the calculation of the moving standard deviation σa, it is desirable to use a plurality of readings of the engine revolution information obtained over a time although the information reading time should be adjusted depending on the periods at which the control unit 111 reads the engine revolution information. For example, the information reading time can be set to 0.3 to 5 seconds so as to obtain 30 to 50 readings of the engine revolution information when the engine revolution information is read at periods of 10 msec. If the information reading time is too short, the moving standard deviation σa becomes unstable. If the information reading time is too long, by contrast, the moving standard deviation σa becomes unlikely to reflect a change in the engine revolution number N. This raises a difficulty in proper energization control.

In view of the fact that the engine revolution number N increases rapidly from a very low cranking rpm to a few hundred rpm before and after the engine start and is unstable immediately after the engine start, the moving standard deviation σa is assumed to take a very large value during the period before and after the engine start. Such a large standard deviation value may not be useful for proper evaluation of the engine revolution stability. It is thus desirable, for the calculation of the moving standard deviation σa, not to use the readings of the engine revolution information obtained immediately after the engine start and more specifically, until after the lapse of a predetermined time period of e.g. several seconds (2 seconds in the present embodiment) from the engine start.

Alternatively, the engine revolution stability can be evaluated by detecting any other parameter such as the intensity of engine vibration caused due to unstable engine revolution (e.g. upon the occurrence of misfire in any engine cylinder or cylinders) or specific frequency component of engine vibration.

The low-temperature post-start glow is performed when the engine revolution stability is higher than or equal to the given level after the start of the engine. The energization of the sheath heater 2 during the low-temperature post-start glow (referred to as "low-temperature post-start glow energization") is controlled according to the first post-start glow control pattern so as to maintain the sheath heater temperature TG at the first target post-start glow temperature for a predetermined time period of e.g. 180 seconds. In a state where the engine revolution is stable, the glow plug GP is capable of assisting ignition, preventing knocking noise and white smoke developments and reducing HC emissions efficiently even if the heater temperature TG is not so high. The first target post-start glow temperature is set at a relatively low level in order to shorten the time of high-temperature heating of the sheath heater 2. This makes it possible to improve the durability of the glow plug GP (sheath heater 2) for longer-term use of the glow plug GP. The low-temperature post-start glow is also effective in avoiding undesired power (energy) consumption.

The high-temperature post-start glow is performed when the engine revolution stability has not reached the given level after the start of the engine. The energization of the sheath heater 2 during the high-temperature post-start glow (referred to as "high-temperature post-start glow energization") is controlled according to the second post-start glow control pattern so as to maintain the heater temperature TG at the second target post-start glow temperature until the engine revolution stability reaches the given level. As mentioned above, the second target post-start glow temperature is set higher than the first target post-start glow temperature. The heater temperature TG rises to such a higher level as to promote engine warm-up and assist ignition assuredly and to increase the engine revolution stability even in a state where it takes time to stabilize engine revolution due to occurrence of misfire (rough idling) during cold engine starting. This makes it possible to stop uncomfortable engine vibration and noise quickly and prevent unburned gas emissions.

There is no particular restriction on the method of controlling the upkeep glow energization, the cranking glow energization and the post-start glow energization as long as the method allows the heater temperature TG to be controlled properly. For easy and accurate control of the upkeep glow energization, the cranking glow energization and the post-start glow energization, it is preferable to adopt PWM (pulse-width modulation) control of the glow plug voltage V. The PWM control has an advantage in that the amount of power supplied to the glow plug GP can be adjusted easily and accurately according to a duty ratio of the pulse waveform of the glow plug voltage V. In this case, the duty ratios Da1 and Da2 for PWM control during the low-temperature post-start glow and the high-temperature post-start glow are determined to satisfy the relationship of Da1<Da2 in order that the heater temperature TG can be set higher in the high-temperature post-start glow than in the low-temperature post-start glow. In order to supply a larger amount of power during the cranking glow than during the upkeep glow and avoid a drop in the heater temperature TG after shifting from the upkeep glow to the cranking glow, the duty ratios Dh and Dk for PWM control during the upkeep glow and the cranking glow are determined to satisfy the relationship of Dh<Dk on the assumption that the glow plug voltage V takes the same value in these glow phases.

During the low-temperature post-start glow, there is a possibility that the heater temperature TG may be decreased due to external factors e.g. fuel injection and swirl so that it is necessary to heat the sheath heater 2 stably while allowing for such a decrease in the heater temperature TG Further, the sheath heater 2 is in a steady state where the resistance R of the sheath heater 2 has a correlation with the heater temperature TG during the post-start glow. The heather temperature TG can be thus controlled more accurately by determining the PWM duty ratios Da1 and Da2 based on the resistance R of the sheath heater 2. Also, the heater temperature TG can be controlled with a simple configuration when the PWM duty ratios Da1 and Da2 are preset corresponding to each value of the heater resistance R.

The detail routine procedure of the energization control of the glow plug energization control apparatus 101 will be explained with reference to FIGS. 4 to 13.

As shown in FIG. 4, the control unit 111 first carries out initialization at step S1 to bring a total power accumulation Gw of the glow plug GP to zero (Gw=0), set a pre-glow execution flag (indicative of the execution of the pre-glow) and clears a pre-glow completion flag (indicative of the completion of the pre-glow), a start signal input flag (indicating of the receipt of the start signal), a post-start glow execution flag (indicative of the execution of the post-start start glow) and an engine start flag (indicating of the engine start).

Next, the control unit 111 reads voltage V and current I applied to each glow plug GP and determines a current resistance value R of the sheath heater 2 based on these values V and I at step S2.

Figure 5:
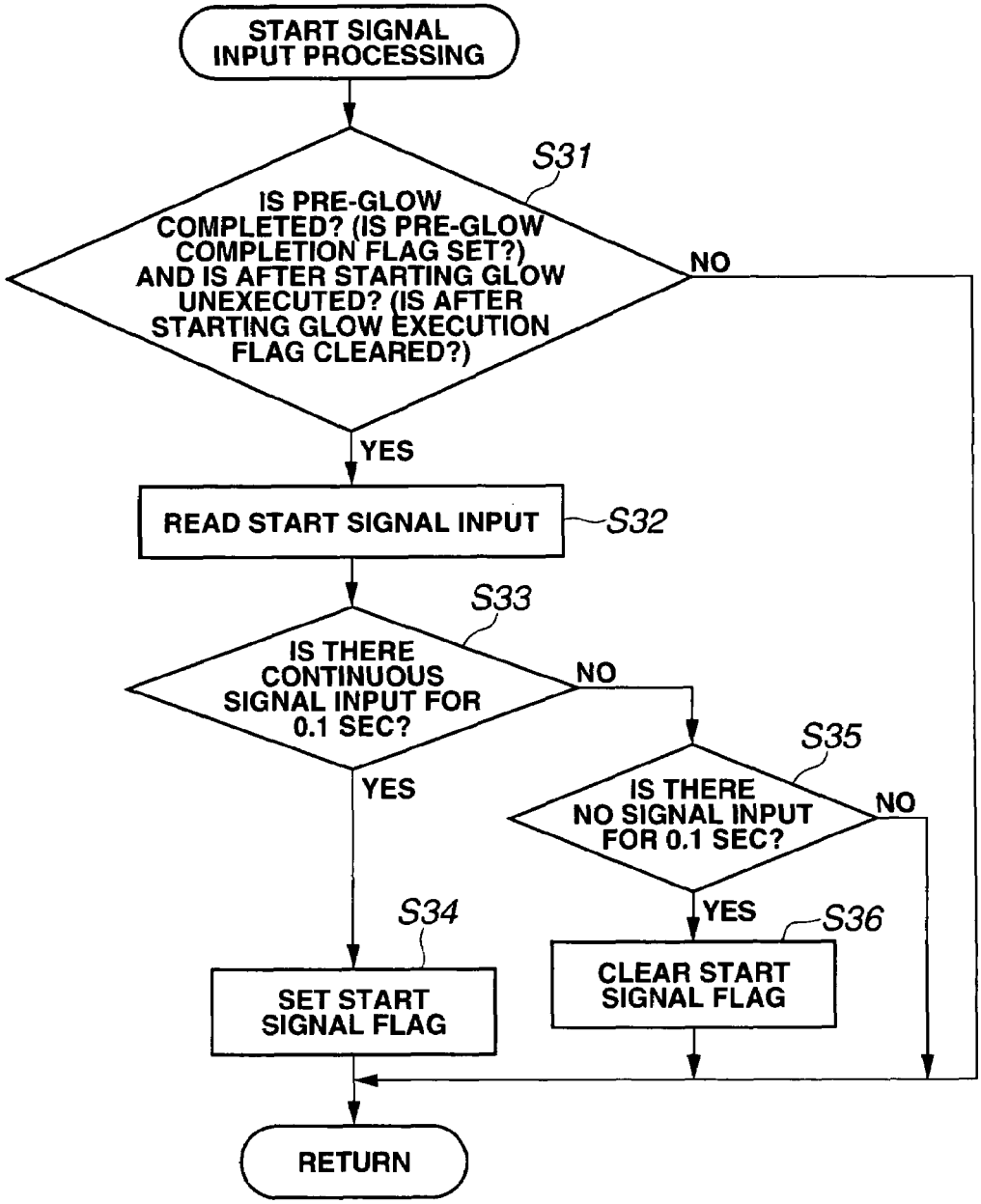
FIG. 5 is a flowchart for a start signal input processing subroutine of the glow plug energization control apparatus according to one embodiment of the present invention.

At step S3, the control unit 111 carries out start signal input processing as shown in FIG. 5.

In the start signal input processing, the control unit 111 checks at step S31 whether the pre-glow has been completed and the post-start glow has not yet been executed, i.e., whether the pre-glow completion flag is set and the post-start glow execution flag is cleared. If Yes at step S31, the control goes to step S32. If No at step S31, the control returns to the main control routine.

At step S32, the control unit 111 reads the start signal from the key switch KSW via the interface circuit 104 at established periods.

At step S33, the control unit 111 checks whether there is a continuous input of the start signal for 0.1 sec (8 consecutive signal periods) in order to avoid the misreading of the start signal input due to noises etc. If Yes at step S33, the control goes to step S34. If No at step S33, the control goes to step S35.

At step S34, the control unit 111 sets the start signal input flag upon judging that the key switch KSW has been turned to the START position.

At step S35, the control unit 111 checks whether there is no continuous input of the start signal for 0.1 sec (8 consecutive signal periods). If Yes at step S35, the control goes for step S36. If No at step S35, the control returns to the main control routine.

At step S36, the control unit 111 clears the start signal input flag, upon judging that the key switch KSW is not in the START position. The control returns to the main control routine.

In the main control routine, the control unit 111 calculates at step S4 the duty ratios Dh and Dk for PWM control during the upkeep glow and the cranking glow.

It is herein desirable that the control unit 111 stores tables defining the correlations of the duty ratios Dh and Dk with the glow plug voltage V and determines the duty ratios Dh and Dk with reference to the table although the duty ratios Dh and Dk can alternatively be determined according to computational equations at every execution of step S4. In this case, the tables or computational equations are adjusted in such a manner that the duty ratio Dk is larger than the duty ratio Dh on the assumption that the glow plug voltage V takes the same value during the upkeep glow and the cranking glow, as mentioned above, so as to supply a larger amount of power during the cranking glow than during the upkeep glow avoid a drop in the sheath heater temperature TG after shifting from the upkeep glow to the cranking glow.

Figure 6:
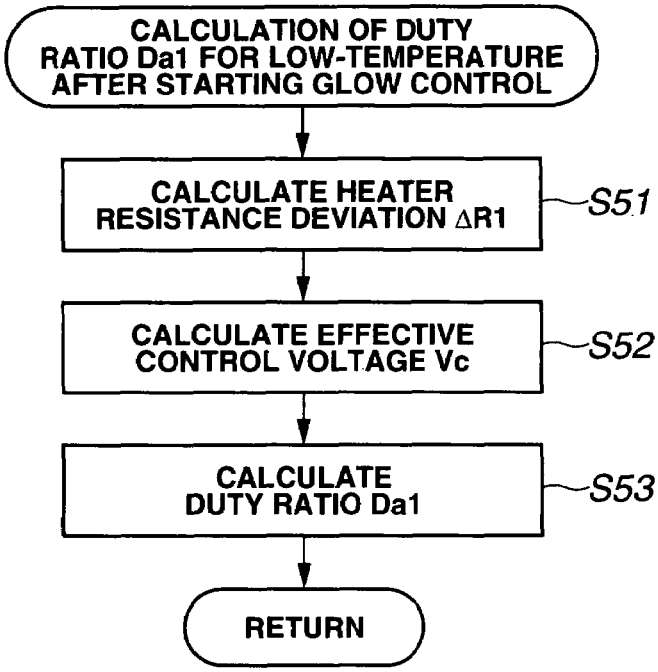
FIGS. 6 and 7 are flowcharts for duty ratio calculation subroutines of the glow plug energization control apparatus according to one embodiment of the present invention.

At step S5, the control unit 111 makes a calculation of the duty ratio Da1 for PWM control during the low-temperature post-start glow as shown in FIG. 6.

In this PWM duty ratio calculation, the control unit 111 calculates at step S51 a current actual resistance R of the sheath heater 2, a target resistance Rt1 of the sheath heater 2 at the first target post-start glow temperature and a deviation ΔR1 between the actual heater resistance R and the target heater resistance Rt1 (ΔR1=Rt1−R).

At step S52, the control unit 111 calculates an effective control voltage Vc according to the following equation:

$$Vc=K0+K1\Delta R1+K2\int\Delta R1dt$$

where each of K0, K1 and K2 is a constant greater than zero (K0, K1, K2>0).

At step S53, the control unit 111 calculates the duty ratio Da1 according to the following equation:

$$Da1=Vc^2/Vb^2$$

where Vb is the glow plug voltage read at step S2. After that, the control returns to the main control routine.

Figure 7:
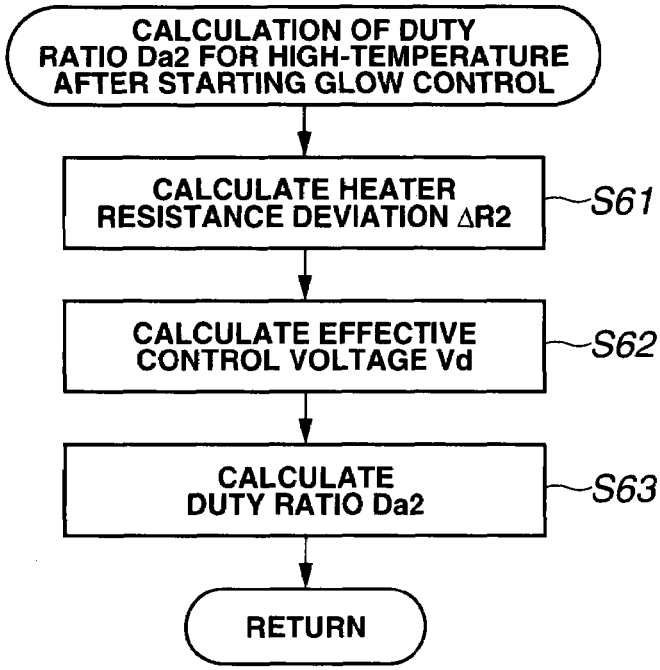

At step S6, the control unit 111 makes a calculation of the duty ratio Da2 for PWM control during the high-temperature post-start glow as shown in FIG. 7.

In this PWM duty ratio calculation, the control unit 111 calculates at step S61 a current actual resistance R of the sheath heater 2, a target resistance Rt2 of the sheath heater 2 at the second target post-start glow temperature and a deviation ΔR2 between the actual heater resistance R and the target heater resistance Rt2 (ΔR2=Rt2−R).

At step S62, the control unit 111 calculates an effective control voltage Vc according to the following equation:

$$Vd=K3+K4\Delta R2+K5\int\Delta R2dt$$

where each of K3, K4 and K5 is a constant greater than zero (K3, K4, K5>0).

At step S63, the control unit 111 calculates the duty ratio Da2 according to the following equation:

$$Da2=Vd^2/Vb^2$$

where Vb is the glow plug voltage read at step S2.

After that, the control returns to the main control routine.

Figure 8:
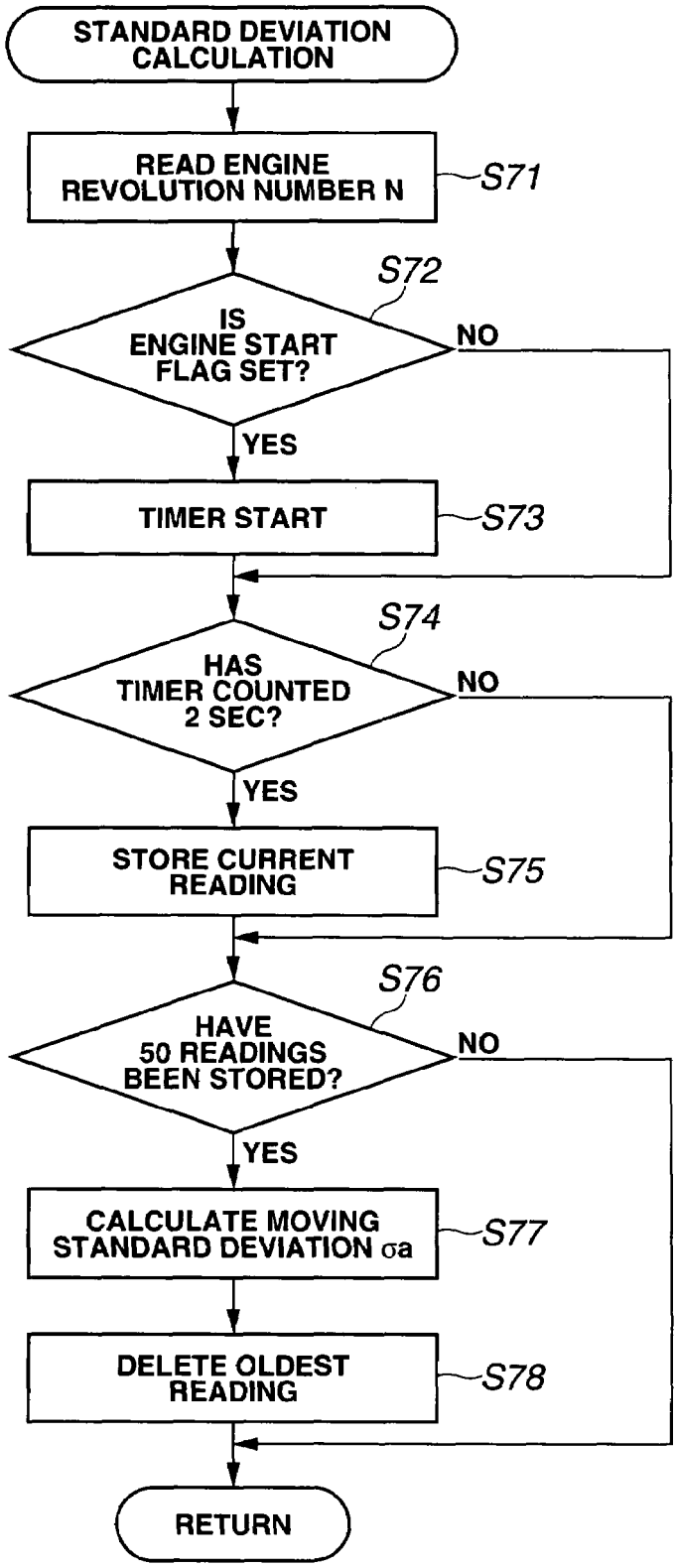
FIG. 8 is a flowchart for a standard deviation calculation subroutine of the glow plug energization control apparatus according to one embodiment of the present invention.

At step S7, the control unit 111 makes a calculation of the moving standard deviation σa of the engine revolution number N as shown in FIG. 8.

In the standard deviation calculation, the control unit 111 obtains at step S71 a current reading of the engine revolution number N from the ECU 201 via the interface circuit 106.

At step S72, the control unit 111 checks whether the engine has been started, i.e., whether the engine start flag is set. If Yes at step S72, the control goes to step S73. If No at step S72, the control skips step S73 and goes to step S74.

At step S73, the control unit 111 starts a timer. After that, the control goes to step S74.

At step S74, the control unit 111 judges whether the timer has counted 2 seconds or more. If Yes at step S74, the control goes to step S75. If No at step S74, the control skips step S75 and goes to step S76.

At step S75, the control unit 111 stores the current reading of the engine revolution number N.

At step S76, the control unit 111 judges whether there have been 50 readings of the engine revolution number N stored. If Yes at step S76, the control goes to step S77. If No at step S76, the control unit 111 skips steps S77 and S78 and returns to the main control routine.

The reason that the control unit 111 stores 50 readings of the engine revolution number N obtained after the lapse of 2 seconds from the engine start (judged in step S92 as described later) and does not stores any readings of the engine revolution number N obtained before the lapse of 2 seconds from the engine start is to determine whether the engine is ready for revolution stability evaluation and to achieve a suitable and effective standard deviation calculation result for the evaluation of the engine revolution stability as explained above.

At step S77, the control unit 111 calculates the moving standard deviation ca of the engine revolution number N according to the following equations:

$$\sigma a = \sqrt{\{(N0 - DA)^2 + (N1 - DA)^2 + \ldots + (N49 - DA)^2\}/50}\text{; and}$$

$$DA = (N0 + N1 + \ldots + N49)/50$$

where DA is the moving average of the engine revolution number N; N0 is the latest value of the engine revolution number N; and Nn is the nth previous value of the engine revolution number N (n=1 to 49).

At step S78, the control unit 111 deletes therefrom the oldest one of 50 stored readings of the engine revolution number N, so as to store a new reading of the engine rotation number N in the next cycle of the standard deviation calculation subroutine. The control returns to the main control routine.

In the main control routine, the control unit 111 checks at step S8 whether the engine is cranking, i.e., whether the start signal input flag is set. If Yes at step S8, the control goes to sfep S9. If No at step S8, the control goes to step SB.

Figure 9:
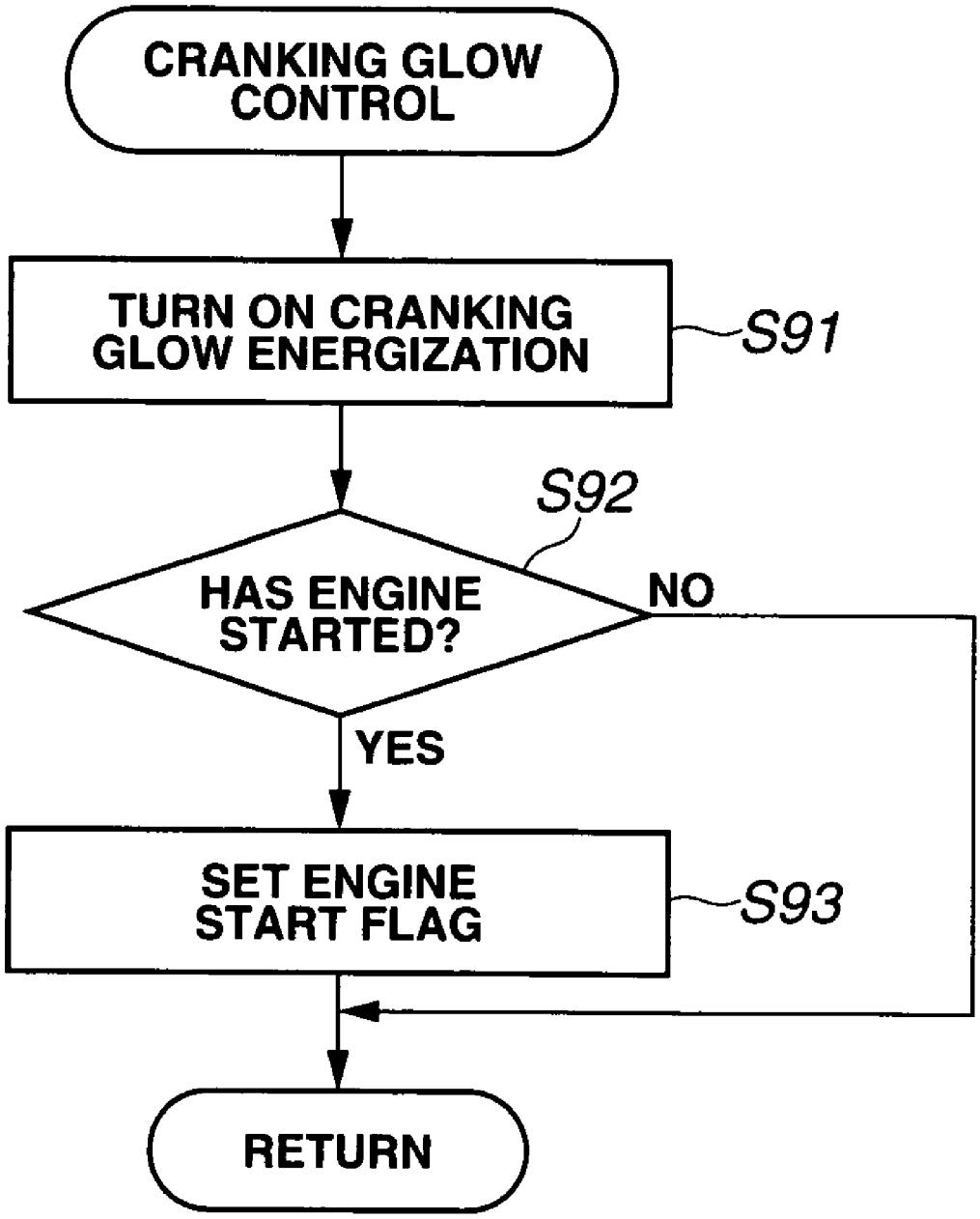
FIG. 9 is a flowchart for a cranking glow control subroutine of the glow plug energization control apparatus according to one embodiment of the present invention.

At step S9, the control unit 111 controls the cranking glow energization as shown in FIG. 9.

In the cranking glow control, the control unit 111 turns on the cranking glow energization at step S91 to perform PWM control using the duty ratio Dk calculated at step S4.

At step S92, the control unit 111 reads the engine revolution N from the ECU 201 and checks whether the engine revolution number N is higher than or equal to the threshold level Nth (Nth=800 rpm in the present embodiment). If Yes at step S92, the control goes to step S93. If No at step S93, the control skips step S93 and goes to step SA in the main control routine.

At step S93, the control unit 111 sets the engine start flag upon judging that the engine has started. After that, the control goes to step SA in the main control routine.

When it is judged at step S8 that the engine is not cranking (No at step S8), the control unit 11 receives the output of the alternator 211 and checks whether the alternator 211 has been actuated. If Yes at step SB, the control goes to step SC. If No at step SB, the control goes to step SG.

At step SC, the control unit 111 checks whether the moving standard deviation σa of the engine revolution number N has been calculated. As explained above, it can be assumed that the engine is ready for revolution stability evaluation when the moving standard deviation σa of the engine revolution number N has been calculated. If Yes at step SC, the control goes to step SD. If No at step SC, the control skips step SD and goes to step SE.

At step SD, the control unit 111 checks whether the moving standard deviation σa of the engine revolution number N is larger than the threshold value σth. If Yes at step SD (σa>σth), the control goes to step SE. If No at step SD (σa≦σth), the control goes to step SF.

Figure 10:
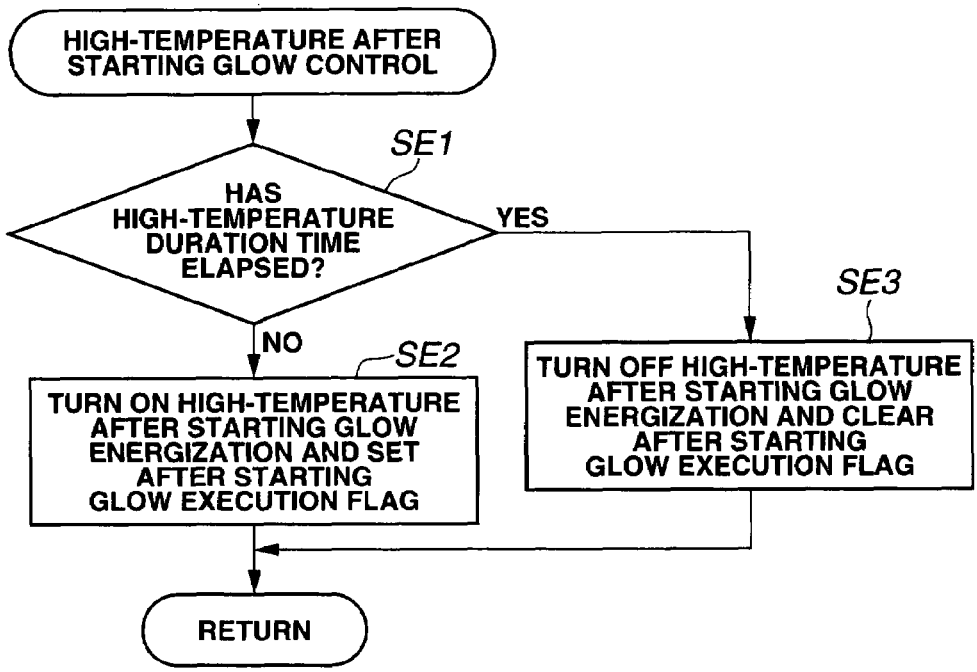
FIG. 10 is a flowchart for a high-temperature post-start glow control subroutine of the glow plug energization control apparatus according to one embodiment of the present invention.

At step SE, the control unit 111 controls the high-temperature post-start glow energization as shown in FIG. 10 upon judging that the engine revolution stability is relatively low due to rough idling with the occurrence of misfire in the engine cylinder dr cylinders.

In the high-temperature post-start glow control, the control unit 111 checks at step SE1 whether a predetermined high-temperature duration time of e.g. 180 seconds has elapsed after the initiation of the high-temperature post-start glow energization. If No at step SE1, the control goes to step SE2. If Yes at step SE1, the control goes to step SE3.

At step SE2, the control unit 111 turns on the high-temperature post-start glow energization to perform PWM control using the duty ratio Da2 calculated at step S6 and sets the post-start glow execution flag. The control returns to the main control routine.

When the engine revolution stability is low after the engine start or when only a short time (e.g. 2.6 seconds or less) has elapsed after the engine start, the heater temperature TG is maintained at the relatively-high second target post-start glow temperature under the high-temperature post-start glow energization. The sheath heater 2 is thus able to assist ignition and prevent misfire even in the state where engine rough idling occurs due to misfire during cold engine starting. This makes it possible to stabilize engine revolution early, prevent engine vibration and noise and reduce unburned gas emissions. Further, the early stabilization of the engine revolution allows early convergence of the moving standard deviation σa so that the energization control omits the high-temperature post-start glow (step SE) and performs the low-temperature post-start glow (step SF) directly upon judgment of σa≦σth.

After the lapse of the high-temperature duration time (Yes at step SE1), the control unit 111 turns off the high-temperature post-start glow energization, clears the post-start glow execution flag at step SE3. The control returns to the main control routine.

When the moving standard deviation σa does not become so small even after the lapse of the high-temperature duration time, the high-temperature post-start glow is discontinued at an adequate timing in order to prevent the operation life of the glow plug GP from becoming shortened by high-temperature heating of the sheath heater 2.

Figure 11:
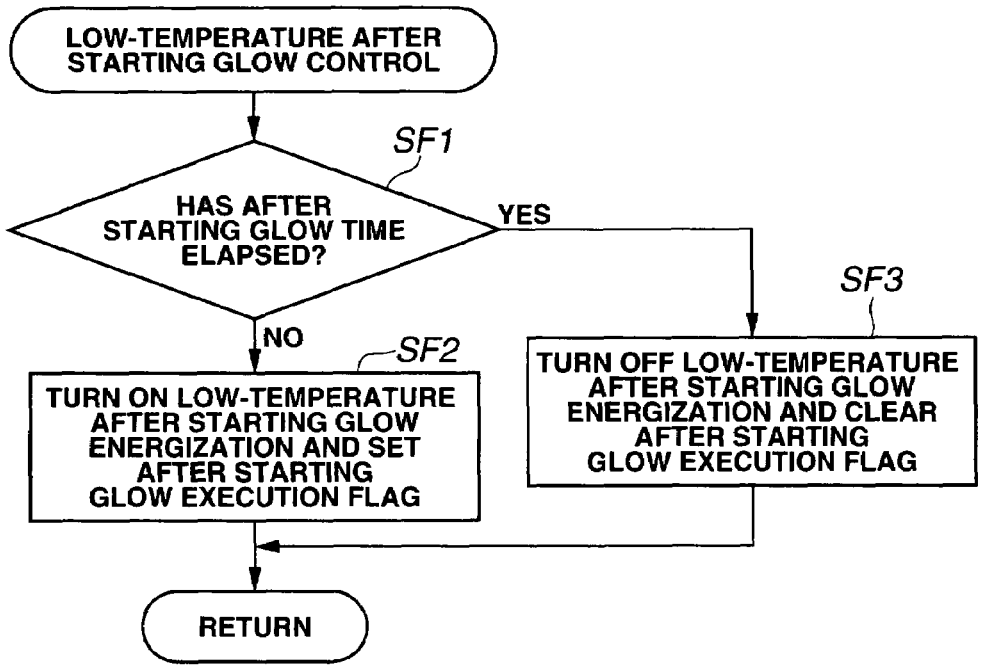
FIG. 11 is a flowchart for a low-temperature post-start glow control subroutine of the glow plug energization control apparatus according to one embodiment of the present invention.

At step SF, the control unit 111 controls the low-temperature post-start glow energization as shown in FIG. 11 upon judging that the engine revolution stability is relatively high with proper ignition in each engine cylinder.

In the low-temperature post-start glow control, the control unit 111 checks at step SF1 whether a predetermined post-start glow time (e.g. 180 seconds) has elapsed after the initiation of the post-start glow energization at step SE or SF. If No at step SF1, the control goes to step SF2. If Yes at step SF1, the control goes to step SF3.

At step SF2, the control unit 111 turns on the low-temperature post-start glow energization to perform PWM control using the duty ratio Da1 calculated at step S5, sets the post-start glow execution flag, and then, returns to the main control routine.

When the engine revolution stability is high after the engine start, the heater temperature TG is maintained at the moderately-high first target post-start glow temperature under the low-temperature post-start glow energization. The sheath heater 2 is thus able to assist ignition and prevent misfire for clean exhaust emissions.

At step SF3, the control unit 111 turns off the low-temperature post-start glow energization and clears the post-start glow execution flag. The control returns to the main control routine.

After the lapse of the predetermined post-start glow time, it can be judged that there is no need for the sheath heater 2 (the glow plug GP) to assist ignition and combustion. For this reason, the post-start glow is stopped at an adequate timing in order to attain low power consumption and prevent the operation life of the glow plug GP from being shortened by high-temperature heating of the sheath heater 2.

Figure 12:
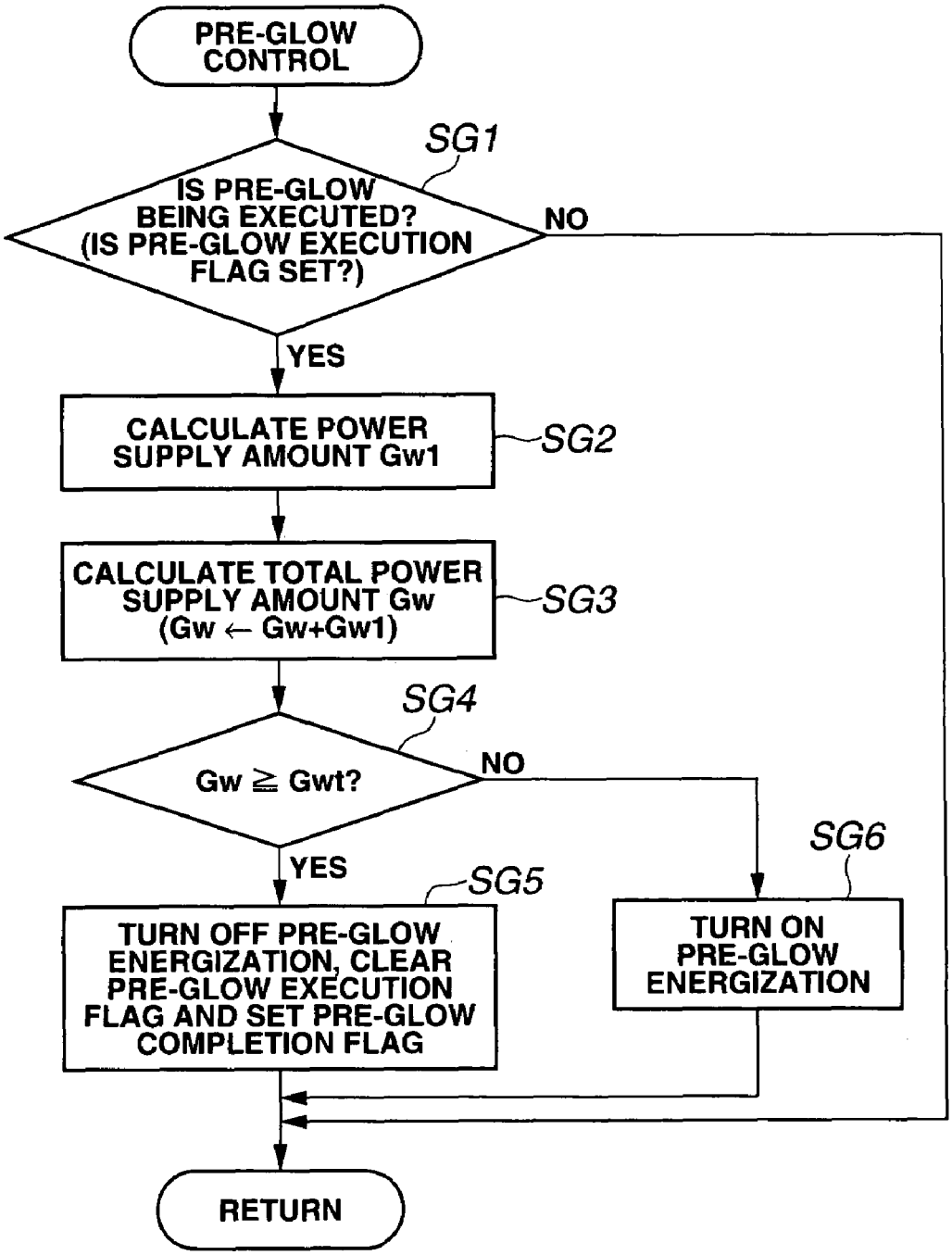
FIG. 12 is a flowchart for a pre-glow control subroutine of the glow plug energization control apparatus according to one embodiment of the present invention.

When it is judged at step SB that the alternator 211 has not yet been actuated (No at step SB), the control unit 111 controls the pre-glow energization as shown in FIG. 12.

In the pre-glow control, the control unit 111 checks at step SG1 whether the pre-glow is being executed, i.e., whether the pre-glow execution flag is set. If Yes at step SG1, the control goes to step SG2. If No at step SG1, the control returns to the main control routine.

At step SG2, the control unit 111 calculates, based on the glow plug voltage V and current I read at step S2, the amount Gw1 of power supplied to the glow plug GP between the last and current cycles of the pre-glow control subroutine.

At step SG3, the control unit 111 increments the total power accumulation Gw of the glow plug GP by the calculated power amount Gw1.

At step SG4, the control unit 111 checks whether the total power accumulation Gw of the glow plug GP becomes greater than or equal to a target power amount Gwt corresponding to the target pre-glow temperature. If No at step SG4, the control goes to step SG6. If Yes at step SG4, the control goes to step SG5.

At step SG5, the control unit 111 turns off the pre-glow energization, clears the pre-glow execution flag and sets the pre-glow completion flag. The control returns to the main control routine.

At step SG6, the control unit 111 turns on the pre-glow energization to allow continuous application of the battery voltage to the glow plug GP. After that, the control returns to the main control routine.

Figure 13:
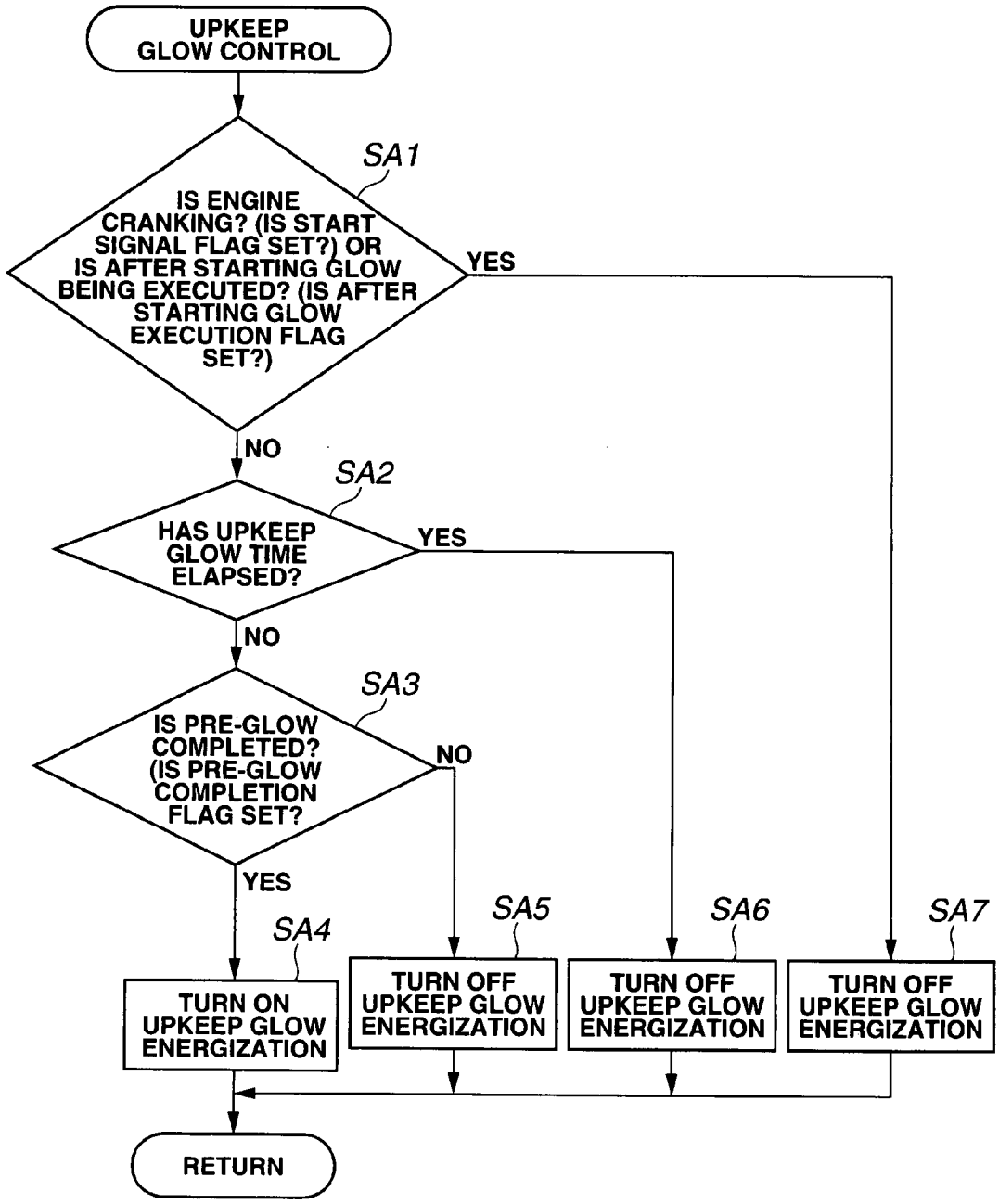
FIG. 13 is a flowchart for an upkeep glow control subroutine of the glow plug energization control apparatus according to one embodiment of the present invention.

At step SA, the control unit 111 controls the upkeep glow energization as shown in FIG. 13.

In the upkeep glow control, the control unit 111 checks at step SA1 whether the engine is cranking or the post-start glow has been executed, i.e., whether either the start signal input flag or the post-start glow execution flat is set. If Yes at step SA1, the control goes to step SA7. If No at step SA1, the control goes to step SA2.

At step SA2, the control unit 111 checks whether a predetermined upkeep glow time has elapsed after the initiation of the upkeep glow energization. If Yes at step SA2, the control goes to step SA6. If No at step SA2, the control goes to step SA3.

At step SA3, the control unit 111 checks whether the pre-glow has been completed, i.e., whether the pre-glow completion flag is set. If Yes at step SA3, the control goes to step SA4. If No at step SA3, the control goes to step SA5.

At step SA4, the control unit 111 turns on the upkeep glow energization to perform PWM control using the duty ratio Dh calculated at step S4.

At step SA5, SA6 and SA7, the control unit 111 turns off the upkeep glow energization. The control returns to the main control routine.

In the main control routine, the control unit 111 finally judges at step SH whether one control cycle period (12.5 ms in the present embodiment) has elapsed. If Yes at step SH, the control returns to step S2. If No at step SH, the control unit 111 repeats step SH until after the lapse of one control cycle period.

Figure 14A:
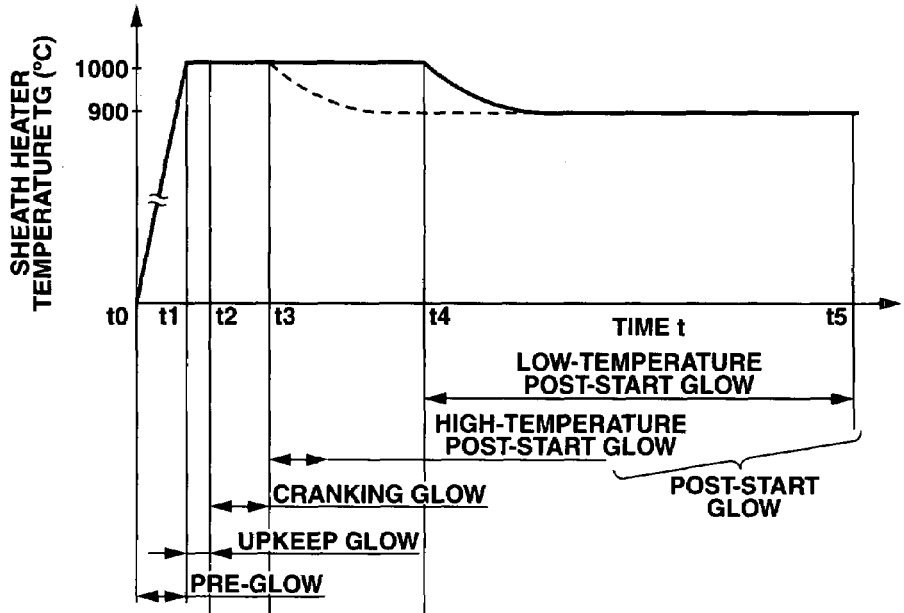
FIGS. 14A, 14B and 14C are graphs showing changes in resistance heater temperature, engine speed and engine speed standard deviation under glow plug energization control according to one embodiment of the present invention and according to the earlier technology.
Figure 14B:
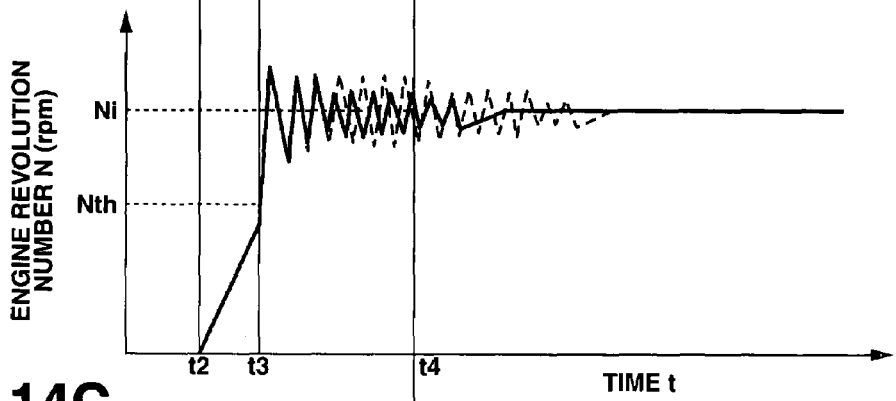
Figure 14C:
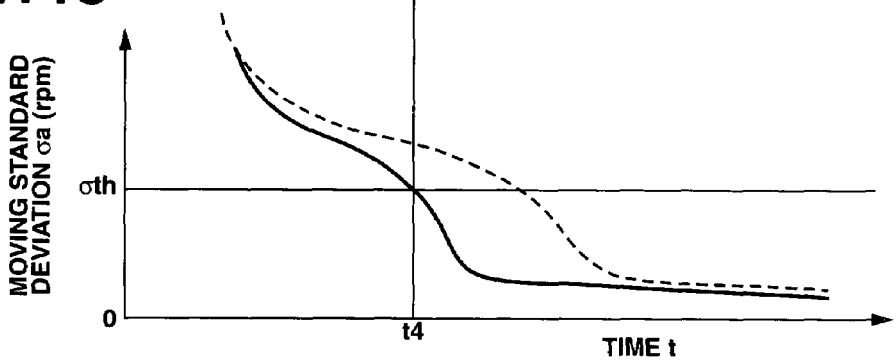

The effects of the above energization control of the glow plug energization control system 100 will be explained below with reference to FIGS. 14A to 14C. It is now assumed that the glow plug GP is mounted on an actual four-cylinder engine (piston displacement: 2.5 L) and operated in a low-temperature environment of e.g. −40° C., −20° C.; in the present embodiment, −20° C. In FIGS. 14A to 14C, parameter changes under the energization control according to the present embodiment and under energization control according to the earlier technology are indicated by solid lines and broken lines, respectively.

When the key switch KSW is turned by a driver from the OFF position to the ON position, the glow plug energization control apparatus 101 becomes actuated so that the main control unit 111 initiates energization control according to the prestored control program.

The control unit 111 first carries out initialization in step S1.

Although the control proceeds from step S1 to step S2, the control unit 111 does not determine the glow plug voltage V, the glow plug current I and the heater resistance R in step S2 for the reason that the glow plug GP is still de-energized at this time.

The control next proceeds to step S3 to enter into the start signal input processing subroutine and soon exits the start signal input processing subroutine on the basis of the judgment in step S31. The control then goes to step S4.

In step S4, the control unit 111 calculates the duty ratios Dh and Dk.

The control subsequently proceeds to steps S5 and S6, but the control unit 111 cannot calculate the duty ratios Da1 and Da2 accurately in steps S5 and S6 for the reason that the heater resistance R has not been determined in step S2.

The control proceeds to step S7 to enter into the standard deviation calculation subroutine, but the control unit 111 does not also calculate the moving standard deviation σa on the basis of the judgments in steps S72, S74 and S76. The control returns from step S76 to the main control routine.

At this time, the engine is not cranking and the alternator 211 is not in operation. On the basis of the judgments in steps S8 and SB, the control proceeds to step SG to enter into the pre-glow control subroutine so that the control unit 111 starts the pre-glow energization through steps SG1, SG2, SG3, SG4 and SG6.

After that, the control proceeds to step SA to enter into the upkeep glow control subroutine. The control unit 111 keeps the upkeep glow energization turned off in step SA5 on the basis of the judgments in steps SA1, SA2 and SA3. The control then returns from step SA5 to the main control routine and goes back to step S2 through step SH.

During the period between time t0 and time t1, the control unit 111 continues the pre-glow energization by the repeated cycles of steps S2, S3 (S31), S4, S5, S6, S7 (S71, S72, S74, S76), S8, SB, SG (SG1, SG2, SG3, SG4, SG6), SA (SA1, SA2, SA3, SA5) and SH until the total power accumulation Gw of the glow plug GP becomes greater than or equal the target power amount Gwt. The duty ratios Dh, Dk, Da1 and Da2 can be calculated in step S4, S5 and S6 after the initiation of the pre-glow but are not used during the pre-glow.

The pre-glow energization is conducted by the continuous application of voltage power from the battery BT. The heater temperature TG increases linearly and rapidly to 1000° C. (the target pre-glow temperature) during the pre-glow as shown in FIG. 14A.

Upon judgment in step SG4 that the total power accumulation Gw of the glow plug GP becomes greater than or equal the target power amount Gwt, the control unit 111 turns off the pre-glow energization, clears the pre-glow execution flag and sets the pre-glow completion flag in step SG5.

The control subsequently proceeds to step SA to enter into the upkeep glow control subroutine. The control unit 111 turns on the upkeep glow energization in step SA4 on the basis of the judgments in steps SA1, SA2 and SA3. With this, the energization control shifts from the pre-glow phase to the upkeep glow phase at time t1. After that, the control returns to the main control routine and goes back to step S2 through step SH.

In step S2, the control unit 111 determines the glow plug voltage V, the glow plug current I and the heater resistance R.

The control next proceeds to step S3 to enter into the start signal input processing subroutine. On the basis of the judgment in step S31, the control unit 111 reads the input of the start signal in step S32. However, the key switch is not yet turned to the START position at this time. The control unit 111 thus keeps the start signal input flag cleared in step S36 on the basis of judgments in steps S33 and S35. The control returns to the main control routine and goes through steps S4, S5 and S6.

In steps S4, S5 and S6, the control unit 111 calculates the duty ratios Dh, Dk, Da1 and Da2 although the duty ratios Dk, Da1 and Da2 are not used during the upkeep glow.

The control proceeds to step S7 to enter into the standard deviation calculation subroutine, but the control unit 111 does not yet calculate the moving standard deviation σa on the basis of the judgments in steps S72, S74 and S76. The control returns to the main control routine and proceeds to step S8.

The engine is not yet cranking and the alternator 211 is not in operation at this time. The control thus proceeds to step SG to enter into the pre-glow control subroutine on the basis of the judgments in steps S8 and SB and soon exits the pre-glow control subroutine on the basis of the judgment in step SG1.

Subsequently, the control proceeds to step SA to enter into the upkeep glow control subroutine in step SA so that the control unit 111 keeps the upkeep glow energization turned on through steps SA1, SA2, SA3 and SA4.

During the period between time t1 and time t2, the control unit 111 continues the upkeep glow energization by the repeated cycles of steps S2, S3 (S31, S32, S33, S35, S36), S4, S5, S6, S7, S8, SB, SG (SG1), SA (SA1, SA2, SA3, SA4) and SH until the predetermined upkeep glow time has elapsed without the key switch KSW being operated by the driver or until the key switch KSW is turned from the ON position to the START position to provide a continuous input of the start signal for 0.1 second or more.

The upkeep glow energization is controlled by PWM control using the duty ratio Dh. As shown in FIG. 14A, the heater temperature TG is maintained at 1000° C. by such PWM energization control during the upkeep glow without causing a drop in the heater temperature TG for improvement in engine startability.

When the key switch KSW is not operated by the driver before the lapse of the upkeep glow time, it can be assumed that there is no longer driver's intention to start the engine. The control unit 111 turns off the upkeep glow energization in step SA6. The control returns to the main control routine and goes back to step S2 through step SH.

When the key switch KSW is turned to the START position to provide a continuous input of the start signal for 0.1 second or more before the lapse of the upkeep glow time, the control unit 111 sets the start signal input flag in step S34 on the basis of the judgment in step S33. The control then proceeds to steps S4, S5 and S6. The engine concurrently starts cranking with a starter.

In steps S4, S5 and S6, the control unit 111 calculates the duty ratios Dh, Dk, Da1 and Da2 although the duty ratios Dh, Da1 and Da2 are not used during the cranking glow.

The control subsequently proceeds to step S7 to enter into the standard deviation calculation subroutine in step S7, but the control unit 111 does not yet calculate the moving standard deviation σa on the basis of the judgments in steps S72, S74 and S76. The control proceeds to step S8.

On the basis of the judgment in step S8, the control next proceeds to step S9 to enter into the cranking glow control subroutine so that the control unit 111 starts the cranking glow energization through steps S91 and S92. With this, the energization control shifts from the upkeep glow phase to the cranking glow phase at time t2.

After that, the control returns to the main control routine and enters into the upkeep glow control subroutine in step SA. On the basis of the judgment in step SA1, the control unit 111 keeps the upkeep glow energization turned off in step SA7. The control then returns to the main control routine and goes back to step S2 through step SH.

In step S2, the control unit 111 determines the glow plug voltage V, the glow plug current I and the heater resistance R.

When the control proceeds from step S2 to step S3 to enter into the start signal input processing subroutine, the control unit 111 reads the input of the start signal in step S32 and keeps the start signal input flag set in step S34 on the basis of the judgments in steps S31 and S33.

During the period between time t2 and time t3, the control unit 111 continues the cranking glow energization by the repeated cycles of steps S2, S3 (S31, S32, S33, S34), S4, S5, S6, S7, S8, S9 (S91, S92), SA (SA1, SA7) and SH until the engine starts to allow actuation of the alternator 211 and stops cranking with the driver's operation to turn the key switch KSW back to the ON position.

The cranking glow energization is controlled by PWM control using the duty ratio Dk. There arises a decrease in the battery voltage (glow plug voltage V) when the battery BT supplies a large current to the starter for engine cranking. Also, the sheath heater 2 may be cooled due to piston movement. The duty ratio Dk for PWM control during the cranking glow is however set larger than the duty ratio Dh for PWM control during the upkeep glow as explained above so that the glow plug GP receives higher voltage power during the cranking glow than during the upkeep glow. The heater temperature TG is maintained at 1000° C. during the cranking glow as shown in FIG. 14A, without causing a drop in the heater temperature TQ for improvement in engine startability even if there arise a decrease in the battery voltage due to cranking and a cooling of the sheath heater 2 due to piston movement.

Upon judgment in step S92 that the engine revolution number N exceeds the threshold level Nth, the control unit 111 sets the engine start flag in step S93 on the basis of the judgment in step S92. Further, the control unit 111 clears the start signal input flag in step S36 on the basis of the judgments in steps S33 and S35 when the key switch KSW is turned from the START position to the ON position.

In steps S4, S5 and S6, the control unit 111 calculates the duty ratios Dh, Dk, Da1 and Da2 although the duty ratios Dh, Dk and Da1 are not used during the subsequent high-temperature post-start glow.

The control next proceeds to step S7 to enter into the standard deviation calculation subroutine. The control unit 111 starts the timer in step S72 but does not calculate the moving standard deviation σa until after the timer counts 2 seconds from the engine start (time t3) and there have been 50 readings of the engine revolution number N stored.

On the basis of the judgments in steps S8, SB and SC, the control proceeds to step SE to enter into the high-temperature post-start glow control subroutine so that the control unit 111 starts the high-temperature post-start glow energization through steps SE1 and SE2. With this, the energization control shifts from the cranking glow phase to the post-start glow phase, notably the high-temperature post-start glow phase, at time t3.

When the program proceeds to step SA to enter into the upkeep glow control subroutine, the control unit 111 keeps the upkeep glow energization turned off in step SA7 on the basis of the judgment in step SA1. After that, the control returns to the main control routine and goes back to step S2 through step SH.

During the period between time t3 and time t4, the control unit 111 continues the high-temperature post-start glow energization by the repeated cycles of steps S2, S3 (S31), S4, S5, S6, S7, S8, SB, SC, SD, SE (SE1, SE2), SA (SA1, SA7) and SH. Upon judgments in step S74 that the timer counts 2 seconds from the engine start and in step S76 that there have been 50 readings of the engine revolution number N stored, the control unit 111 calculates the moving standard deviation σa in step S77. The high-temperature post-start glow energization is continued until the moving standard deviation σa becomes smaller than or equal to the threshold value 6th or until the high-temperature duration time has elapsed.

The high-temperature post-start glow energization is controlled by PWM control using the duty ratio Da2. The duty ratio Da2 for PWM control during the high-temperature post-start glow is set larger than the duty ratio Da1 for PWM control during the low-temperature post-start glow as explained above. By such PWM energization control, the heater temperature TG is maintained at the second target post-start glow temperature (1000° C.), which is higher than the first target post-start glow temperature (900° C.), during the high-temperature post-start glow as shown in FIG. 14A.

Upon judgment in step SD that the moving standard deviation σa becomes smaller than or equal to the threshold value σth, the control proceeds to step SF to enter into the low-temperature post-start glow control subroutine so that the control unit 111 starts the low-temperature post-start glow energization through steps SF1 and SF2. With this, the energization control shifts from the high-temperature post-start glow phase to the low-temperature post-start glow phase at time t4.

After that, the control proceeds to step SA to enter into the upkeep glow control subroutine. The control unit 111 keeps the upkeep glow energization turned off in step SA7 on the basis of the judgment in step SA1. The control then returns to the main control routine and goes back to step S2 through step SH.

After time t4, the control unit 111 continues the low-temperature post-start glow energization by the repeated cycles of steps S2, S3 (S31), S4, S5, S6, S7, S8, SB, SC, SD, SF (SE1, SE2), SA (SA1, SA7) and SH until after the lapse of the predetermined post-start glow time from the initiation of the high- or low-temperature post-start glow energization.

The low-temperature post-start glow energization is controlled by PWM control using the duty ratio Da1. As shown in FIG. 14A, the heater temperature TG is controlled to the first target post-start glow temperature (900° C.) during the low-temperature post-start glow.

Upon judgment in step SF1 that the predetermined post-start glow time has elapsed after the initiation of the post-start glow energization, the control unit 111 turns off the low-temperature post-start glow energization and clears the post-start glow execution flag in step SF3. The control then proceeds to step SA to enter into the upkeep glow control subroutine. The control unit 111 keeps the upkeep glow energization turned off in step SA5 on the basis of judgments in steps SA1, SA2 and SA3. With this, the energization control is completed.

Upon judgment in step SE1 that the high-temperature duration time has elapsed before the moving standard deviation σa becomes smaller than or equal to the threshold value σth, the control unit 111 turns off the high-temperature post-start glow energization and clears the post-start glow execution flag in step SE3. The control then proceeds to step SA to enter into the upkeep glow control subroutine. The control unit 111 keeps the upkeep glow energization turned off in step SA5 on the basis of the judgments in steps SA1, SA2 and SA3. The energization control is completed without undergoing the low-temperature post-start glow phase.

As shown in FIG. 14B, the engine revolution is unstable due to the occurrence of misfire immediately after the engine start.

In the earlier technology, the energization control shifts from the cranking glow phase to the low-temperature post-start glow phase and does not undergo the high-temperature post-start glow phase. As a result, the heater temperature TG becomes relatively low immediately after the engine start as shown in FIG. 14A. The engine lapses in a rough idling state for a long time due to easy occurrence of engine misfire under such low-temperature conditions. The engine revolution cannot be readily stabilized to an idling rpm Ni as indicated by the broken line in FIG. 14B. This results in uncomfortable engine vibration and noise and unburned gas emissions.

In the engine rough idling state, the standard deviation σa takes a relatively large value as indicated by the broken line in FIG. 14C. It is thus shown that the standard deviation σa is a suitable measure to make proper and accurate evaluation of the engine revolution stability.

In the present embodiment, by contrast, the energization control undergoes the high-temperature post-start glow phase between the cranking glow phase and the low-temperature post-start glow phase so as to maintain the heater temperature TG at the relatively-high second target post-start glow temperature immediately after the engine start as shown in FIG. 14A. The sheath heater 2 is thus able to assist ignition and prevent engine misfire. The engine revolution can be readily stabilized as indicated by the solid line in FIG. 14B.

As described above, the glow plug energization control apparatus 101 is structured to control the energization of the sheath heater 2 (glow plug GP) after the engine start according to the first post-start glow control pattern so as to maintain the heater temperature TG at the moderately-high first target post-start glow temperature, in view of the durability and power consumption efficiency of the sheath heater 2, when the engine revolution stability is higher than or equal to the given level. It is therefore possible to promote engine warm-up, prevent misfire and diesel knock and reduce noise and white smoke developments and HC emissions efficiently after the engine start. Further, the glow plug energization control apparatus 101 is structured to control the energization of the sheath heater 2 (glow plug GP) after the engine start according to the second post-start glow control pattern so as to maintain the heater temperature TG at the second target post-start glow temperature higher than the first target post-start glow temperature when the engine revolution stability is lower than the given level. It is therefore possible to promote engine warm-up, prevent misfire and diesel knock and reduce noise and white smoke developments and unburned gas and HC emissions even in the state where the engine revolution is unstable immediately after the engine start. It is also possible to achieve early stabilization of the engine revolution. In this way, the glow plug energization control apparatus 101 (plug energization control system 100) provides engine startability, glow plug durability and high power efficiency.

The entire contents of Japanese Patent Application No. 2006-092202 (filed on Mar. 29, 2006) are herein incorporated by reference.

Although the present invention has been described with reference to the above-specific embodiments of the invention, the invention is not limited to the these exemplary embodiments. Various modification and variation of the embodiments described above will occur to those skilled in the art in light of the above teaching.

The glow plug energization control system 100 may utilize any other driver-operable automatic start mechanism such as a button in place of the key switch KSW.

The control unit 111 may be configured to control the high-temperature post-start glow energization at step SE only when the engine revolution stability is judged to be low based on any engine revolution stability indicator (such as the moving standard deviation σa or difference ΔN of the engine revolution number N) although the high-temperature post-start glow energization is certainly controlled at step SE upon judging at step SC that the moving standard deviation σa of the engine revolution number N has not been calculated after the engine start in the present embodiment.

The heater temperature TG is maintained at 1000° C. during the upkeep glow (between time t1 and t2), the cranking glow (between time t2 and t3) and the high-temperature post-start glow (between time t3 and t4) in the present embodiment, but is not necessarily maintained at the same level during these glow phases. For example, the heater temperature TG may be set higher during the high-temperature post-start glow than during the cranking glow.

Although the first target post-start glow temperature and the second target post-start glow temperature are set to 900° C. and 1000° C., respectively, in the present embodiment, these target post-start glow temperatures can be adjusted appropriately in such a manner that the first target post-start glow temperature is lower than the second target post-start glow temperature in view of the durability and ignition assist function of the sheath heater 2.

The scope of the invention is defined with reference to the following claims.

What is claimed is:

1. An energization control apparatus for a glow plug in an engine, comprising: a post-start glow section to control energization of a resistance heater of the glow plug by a battery after start of the engine, wherein the post-start glow section is configured to:

evaluate revolution stability of the engine; and control the energization of the resistance heater according to a first control pattern when the engine revolution stability is higher than or equal to a threshold level and according to a second control pattern that achieves a higher temperature of the sheath heater than the first control pattern when the engine revolution stability is lower than the threshold level.

2. The energization control apparatus as recited in claim 1, wherein the post-start glow section is configured to communicate with the external device, retrieve information relating to a revolution number of the engine from the external device and evaluate the engine revolution stability based on the retrieved information.

3. The energization control apparatus as recited in claim 2, wherein the post-start glow section is configured to calculate a moving standard deviation of the engine revolution number from the retrieved information and determine that the engine revolution stability is lower than the threshold level when the calculated moving standard deviation is larger than a threshold value.

4. The energization control apparatus as recited in claim 1, wherein the post-start glow section is configured to control the energization of the resistance heater according to the first control pattern in such a manner as to adjust the temperature of the resistance heater to a first target post-start glow temperature.

5. The energization control apparatus as recited in claim 4, wherein the post-start glow section is configured to calculate a first duty ratio of a voltage waveform applied to the glow plug based on a resistance value of the resistance heater and perform PWM control on the energization of the resistance heater with the calculated first duty ratio so as to adjust the temperature of the resistance heater to the first target post-start glow temperature.

6. The energization control apparatus as recited in claim 4, wherein the post-start glow section is configured to control the energization of the resistance heater according to the second control pattern in such a manner as to adjust the temperature of the resistance heater to a second target post-start glow temperature higher than the first target post-start glow temperature.

7. The energization control apparatus as recited in claim 6, wherein the post-start glow section is configured to calculate a second duty ratio of the voltage waveform applied to the glow plug based on the resistance value of the resistance heater and perform PWM control on the energization of the resistance heater with the calculated second duty ratio so as to adjust the temperature of the resistance heater to the second target post-start glow temperature.

8. An energization control apparatus for a glow plug in an engine, comprising:

judging means for judging start of the engine;

evaluating means for evaluating revolution stability of the engine;

low-temperature post-start glow means for controlling energization of a resistance heater of the glow plug so as to attain a first target post-start glow temperature when the engine revolution stability is higher than or equal to a threshold level after the start of the engine; and high-temperature post-start glow means for controlling the energization of the resistance heater of the glow plug so as to attain a second target post-start glow temperature higher than the first target post-start glow temperature when the engine revolution stability is lower than the threshold level after the start of the engine.

9. An energization control method for a glow plug in an engine, comprising:

judging start of the engine;

evaluating revolution stability of the engine;

controlling energization of a resistance heater of the glow plug so as to attain a first target post-start glow temperature when the engine revolution stability is higher than or equal to a threshold level after the start of the engine; and controlling the energization of the resistance heater of the glow plug so as to attain a second target post-start glow temperature higher than the first target post-start glow temperature when the engine revolution stability is lower than the threshold level after the start of the engine.

* * * * *